United States Patent [19]

Walley

[11] Patent Number: 4,581,597

[45] Date of Patent: Apr. 8, 1986

[54] ELECTROMAGNETIC ACTUATOR

[75] Inventor: Omar C. Walley, Mansfield, Ohio

[73] Assignee: Figgie International Inc., Richmond, Va.

[21] Appl. No.: 570,513

[22] Filed: Jan. 13, 1984

[51] Int. Cl.[4] ..... H01H 51/27

[52] U.S. Cl. ..... 335/179; 335/85

[58] Field of Search ..... 335/78–85, 335/179, 92, 180

[56] References Cited

U.S. PATENT DOCUMENTS 3,253,095 5/1966 Richert ..... 335/179

3,525,958 8/1970 Rauterburg ..... 335/179

FOREIGN PATENT DOCUMENTS 769778 3/1957 United Kingdom ..... 335/85

*Primary Examiner*—Harold Broome

*Attorney, Agent, or Firm*—Oldham, Oldham & Weber Co.

[57] ABSTRACT

An electromagnetic actuator is presented wherein a pair of permanent magnets are sandwiched between respective pairs of pole pieces. The pole pieces communicate with an armature to effect the state of actuation of the actuator. A pair of electromagnets, consisting of a wire-wound core, is maintained in close relationship to the pair of permanent magnets, a pole piece separating each permanent magnet from its associated electromagnet. When the electromagnets are not energized, the permanent magnets create a magnetic circuit which pulls the armature into a touch position with one pole piece of each permanent magnet. When the electromagnets are energized, a magnetic field is created which opposes and effectively cancels the magnetic fields of the permanent magnets, creating another magnetic circuit drawing the armature into a touch position with the other pole pieces. When the electromagnets are not energized, the armature is held in a first position by the permanent magnets alone. When energized, the holding power is achieved by the electromagnets, and the permanent magnets are effectively removed from the system.

5 Claims, 4 Drawing Figures

ELECTROMAGNETIC ACTUATOR

TECHNICAL FIELD

The invention herein resides in the art of electromagnetic actuators of the type used in electrical relays for switching connections in an electrical circuit. Particularly, the invention relates to an electromagnetic actuator for a double-throw relay which is side-stable. The invention utilizes an electromagnet in horse-shoe configuration in combination with permanent magnets.

BACKGROUND ART

Numerous types of electrical actuators have been known in the art for use in electrical relays for switching electrical contacts dependent upon the existence of a particular condition. Such actuators typically incorporate an electromagnet with the state of energization of the coil controlling the state of the actuator. If one contact is closed when the actuator coil is de-energized, and another contact is closed when the coil is energized, the relay contacts are said to be double-throw. If contact is made only when the coil is energized and the connection is open when the coil is de-energized, then the relay contacts are single-throw. In the case where the actuator contacts return to a particular position in the absence of coil energization, the relay is known as side-stable. The invention herein relates particularly to a double-throw, side-stable electromagnetic actuator.

Double-throw actuators have typically used springs to hold the contacts closed when the coil is de-energized. In such a case, however, the spring force must be overcome when the coil is energized and the actuator and relay are switched. As a point of fact, it can be shown that an actuator for double-throw contacts must perform three and one-half times the work required for single-throw contacts when the contacts that are closed with the coil de-energized are held closed with spring force. As is well known in the art, the size and weight of the electromagnetic actuator must increase as the required work increases. To provide an electromagnetic actuator of physically small dimension and light weight, means other than springs must be utilized for holding the normally closed contacts or those contacts which are held closed in the absence of coil energization.

A permanent magnet has been used in the industry to replace springs. However, in present actuator magnetic structures employing permanent magnets, a magnetic bias or an air gap, or both, must be used to achieve the proper operation.

It has been known in electrical actuators that it is necessary to have a wide separation between the pick-up and drop-out force curves. It has further become known that the load curves of those forces which must be overcome to effect switching, such as springs, air gaps, and the like, should fall between the pickup and drop-out curves of the actuators. At this point, it should be understood that the pick-up current is that current applied to the coil of the electromagnet of the actuator to achieve switching. In similar fashion, the drop-out current is that current which, when applied to the coil, will be insufficient to hold the contacts in their activated state. As is known in the art, the pick-up and drop-out force curves plot such currents as a function of the switching force operating on the actuator armature, and the gap between the armature and its closed contact position. As just discussed, proper electromagnetic actuator design requires that the load forces of springs, air gaps, electrical contacts, and the like fall between the pick-up and dropout force curves such that the actuator will have both a rapid and positive response to applied voltages.

In the prior art, without the cost of size and weight, it has been impossible to obtain a significant separation between the pick-up and drop-out force curves of a double-throw electromagnetic actuator with the load curves lying therebetween.

While the prior art has taught various types of electromagnetic actuators, and particularly those incorporating a combination of permanent magnets and electromagnets, none have achieved the benefits of the invention as will hereinafter be described. For purposes of background, the following United States Patents are acknowledged as being of interest only: U.S. Pat. Nos. 1,689,946; 2,941,130; 3,284,798; 3,317,871; 3,559,129; 3,621,419; 3,775,715; 3,968,470; 4,015,174; 4,237,439; and 4,286,244.

SUMMARY OF THE INVENTION

In light of the foregoing, it is an object of a first aspect of the invention to provide an electromagnetic actuator which attains substantial separation between the pick-up and drop-out force curves.

Another object of an aspect of the invention is to provide an electromagnetic actuator which is reduced in size and weight over previously known double-throw electromagnetic actuators.

Still another object of an aspect of the invention is to provide an electromagnetic actuator which uses, in combination, an electromagnet and a permanent magnet, and wherein the effect of the permanent magnet is efficiently and effectively switched with energization of the electromagnet.

An additional object of an aspect of the invention is to provide an electromagnetic actuator which uses, in combination, an electromagnet and a permanent magnet, and wherein the effects of the permanent magnet are dominant when the electromagnetic coil is deenergized, and negated when energized.

Still an additional object of an aspect of the invention is to provide an electromagnetic actuator which is simple in construction, reliable in operation, cost effective, and readily produced with state-of-the-art materials and equipment.

The foregoing and other objects of aspects of the invention are achieved by an electromagnetic actuator, comprising: a permanent magnet; a first pole piece extending from one pole of said magnet and having a pole face thereon; a second pole piece extending from another pole of said magnet and having a pole face thereon; an armature maintained in juxtaposition to said pole faces of said first and second pole pieces; and means for selectively engaging said armature with one or the other of said pole faces of said first and second pole pieces.

DESCRIPTION OF DRAWINGS

For a complete understanding of the objects, techniques, and structure of the invention, reference should be had to the following detailed description and accompanying drawings wherein.

BEST MODE FOR CARRYING OUT THE INVENTION

Figure 4:
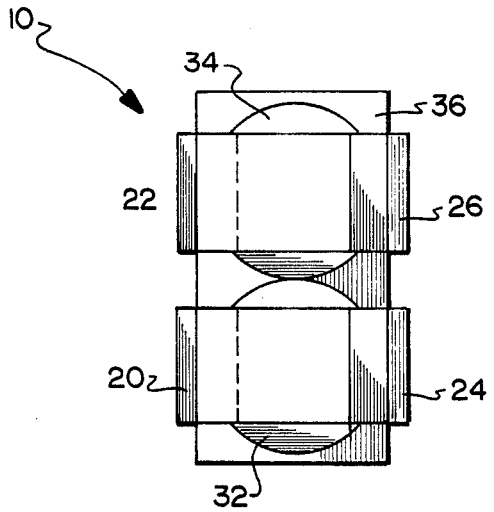
FIG. 4 is a top plan view of the electromagnetic actuator of the invention.

Referring now to the drawings, it can be seen that the electromagnetic actuator of the invention is designated generally by the numeral 10. The actuator is designed for implementation in a double-throw relay which is side-stable. The actuator 10 includes an armature 12 with a pair of pins 14 extending from each end thereof. Preferably, for vibration considerations, the armature 12 is a balanced armature. The pins 14 are adapted for receipt by appropriate bearings to allow limited rotational or pivotal movement of the armature 12.

Figure 2:
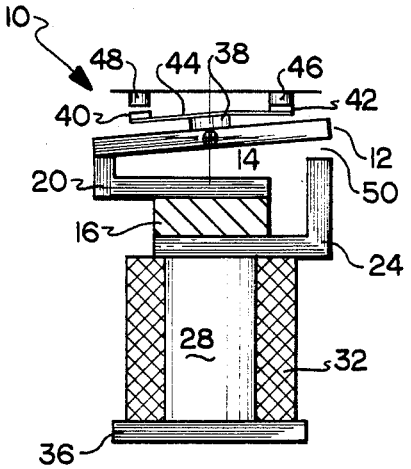
FIG. 2 is a side elevational view of the electromagnetic actuator of the invention which schematically shows incorporation with electrical contacts.
Figure 3:
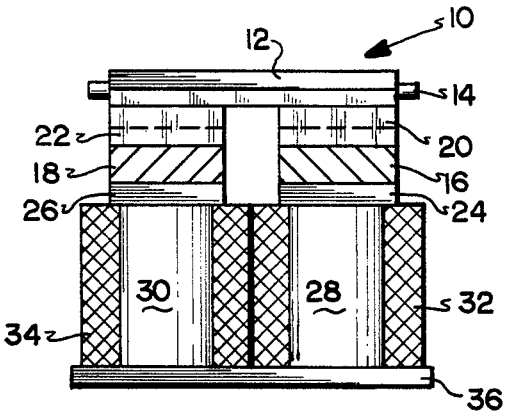
FIG. 3 is a back elevational view of the electromagnetic actuator of the invention.
Figure 1:
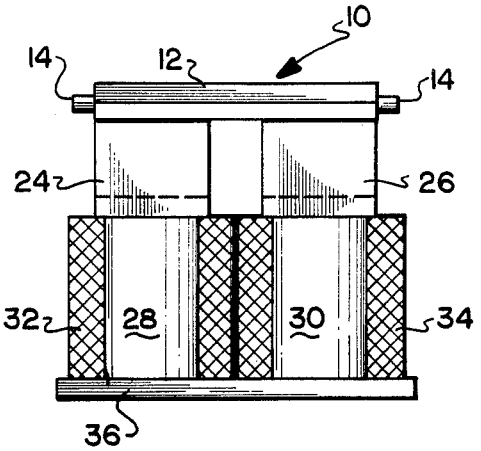
FIG. 1 is a front elevational view of the electromagnetic actuator of the invention.

Permanent magnets 16,18 are maintained between respective upper iron pole pieces 20,22 and lower iron pole pieces 24,26 as best shown in FIGS. 2 and 3. The pole pieces 20,22 and the pole pieces 24,26 are L-shaped with upward extending legs providing contact surfaces or pole faces at the upper ends thereof for selective engagement with the armature 12 in a manner to be discussed hereinafter. As will be appreciated by those skilled in the art, the pole pieces 20,22, contacting one pole of the permanent magnets 16,18, and the pieces 24,26, contacting the other pole, are constructed either of iron or of some metal preferably having a high iron content to assure a good conductive path of magnetic flux. The same is true of the other elements of the invention discussed hereinafter.

Iron cores 28,30 are provided in respective contact with the lower pole pieces 24,26. Wire coils 32,34 envelope the coils 28,30 as shown to comprise an electromagnet. The cores 28,30 are received by a yoke 36, again preferably of iron. It will now be appreciated that the elements 28–36 comprise a double horseshoe electromagnet.

As schematically shown in FIG. 2, the armature 12 has attached thereto an insulating mount 38 for receiving a leaf spring 44 thereon having electrical contacts 40,42 at opposite ends thereof or other electrical contact structure. The electrical contacts 40,42 are adapted for mutual exclusive engagement with respective contacts 48,46 as shown.

With the coils 32,34 de-energized, the armature 12 is held against pole faces of the pieces 20,22 by the magnetic attraction of the permanent magnets 16,18. In such case, the magnetic circuit is through the magnet 16, pole piece 24, core 28, yoke 36, core 30, pole piece 26, magnet 18, pole piece 22, armature 12, pole piece 20, and back to the permanent magnet 16, completing the circuit. An air gap 50 then exists between the armature 12 and the pole faces of the pole pieces 24,26.

When the coils 32,34 are excited by the passing of current therethrough, the resultant magnetic effect of the horseshoe electromagnet opposes the effects of the permanent magnets 16,18 and is of sufficient strength to cancel the permanent magnet effect. Without the permanent magnet effect, there is no force holding the armature 12 to the pole faces 20,22. Of course, the strength of the magnetic field generated by the double horseshoe electromagnet of elements 28–36 is dependent upon the number of windings of the coils 32,34, and the amount of current passed therethrough.

In addition to cancelling or negating the effects of the permanent magnets 16,18, the energized coils 32,34 establish a second magnetic circuit through the core 28, yoke 36, core 30, pole piece 26, air gap 50, armature 12, air gap 50, pole piece 24, and back to the core 28, completing the circuit. The magnetic effect in the air gaps 50 attracts the armature 12 to the pole faces of the pieces 24,26, closing the contacts 40,48 and opening contacts 42,46. In this position, any effects from the permanent magnets 16,18 must cross two relatively large air gaps between the pole faces of pole pieces 20,22 and armature 12. Accordingly, the force produced by the magnetic effect of the permanent magnets 16,18 in this position is negligible. The result is a substantial separation between the pick-up and drop-out force curves of the actuator 10.

When the coils 32,34 are de-energized, the electromagnetic effect terminates. Accordingly, there is no holding force between the armature 12 and the pole faces of the pieces 24,26. Further, the coils 32,34 no longer generate a magnetic field which cancels the magnetic effect of the permanent magnets 16,18. Accordingly, the magnetic effect of the permanent magnets 16,18 attracts the armature 12, causing it to rotate via the pins 14 received in appropriate bearings, back against the pole faces of the pieces 20,22 as shown in FIG. 2.

It should be appreciated with reference to FIG. 2 that the leaf spring 44 deflects upon closure of the pairs of contacts 42,46, or 40,48. The deflection of the spring 44 constitutes a load against which the permanent magnets 16,18 must hold in the unactivated state, and against which the double horseshoe electromagnet must hold in the activated state. In the actuator 10, these loads readily fall between the pickup and drop-out force curves because of the broad separation of such curves achieved by the design herein. As a key element of that design, the permanent magnets 16,18 are dominant in the circuit in the normally closed position as shown in FIG. 2, and are substantially negated by the magnetic effect of the electromagnets 28–36 and the air gaps between the faces of pole pieces 20,22 and the armature 12 when switched to the other position.

It has further been found that the actuator 10 is effectively temperature insensitive. Previously known actuators utilizing permanent magnets have demonstrated a tendency to decrease their release point at high temperatures. Effectively, this changes the separation between the pick-up and drop-out force curves. The instant invention has been found to totally eliminate such problems.

Thus it can be seen that the objects of the invention have been satisfied by the double horseshoe magnetic circuit for an electromagnetic actuator as described herein. The actuator requires less power, and results in a reduction of both size and weight over previously known actuators. While only the best mode and preferred embodiment of the invention has been presented and described in detail, it will be understood that the invention is not limited thereto or thereby. For example, while the invention has been described with respect to two coils, the same advantages could be achieved with a structure having a single coil. The same is true for the contact structures disclosed. Accordingly, for an appreciation of the true scope and breadth of the invention, reference sbould be had to the following claims.

What is claimed is:

1. An electromagnetic actuator, comprising:

a first permanent magnet maintained between first and second pole pieces;

a second permanent magnet maintained between third and fourth pole pieces;

an armature in juxtaposition to pole faces on each end of said pole pieces;

means in communication with said armature for selectively engaging said armature with the pole faces of said first and third or second and fourth pole pieces, said means comprising first and second cores having first and second coils wound thereabout, said first coil communicating with said second and fourth pole pieces; the magnetic field generated by said first and second cores and said first and second coils opposing the magnetic field of said first and second coils opposing the magnetic field of said first and second permanent magnets;

a yoke interconnecting said first and second cores; and wherein said armature is a balanced armature maintained upon a pivot pin between said pole faces of said pole pieces, all of said pole faces being positioned on the same side of said armature.

2. The electromagnetic actuator according to claim 1 wherein a first magnetic circuit is defined from said first permanent magnet, through said second pole piece, first core, yoke, second core, fourth pole piece, second permanent magnet, third pole piece, armature, first pole piece, and return to said first magnet.

3. The electromagnetic actuator according to claim 2 wherein application of current to said coils defines a second magnetic circuit through said first core, yoke, second core, fourth pole piece, armature, second pole piece, and thence returned to said first core.

4. The electromagnetic actuator according to claim 3 wherein activation of said first magnetic circuit defines an air gap between said armature and said first and third pole pieces.

5. The electromagnetic actuator according to claim 3 wherein actuation of said second magnetic circuit defines an air gap between said armature and said second and fourth pole pieces.

* * * * *